US006142197A

United States Patent [19]

Kokko

[11] Patent Number: 6,142,197

[45] Date of Patent: Nov. 7, 2000

[54] DISC FOR A DISC CHIPPER

[75] Inventor: Pekka Kokko, Hollola, Finland

[73] Assignee: Andritz-Patentverwaltungs-GmbH, Graz, Austria

[21] Appl. No.: 09/202,574

[22] PCT Filed: Jun. 9, 1997

[86] PCT No.: PCT/FI97/00356

§ 371 Date: Dec. 16, 1998

§ 102(e) Date: Dec. 16, 1998

[87] PCT Pub. No.: WO97/48533

PCT Pub. Date: Dec. 24, 1997

[30] Foreign Application Priority Data

Jun. 18, 1996 [FI] Finland ..... 962523

[51] Int. Cl.[7] ..... B27C 1/00

[52] U.S. Cl. ..... 144/176; 144/162.1; 241/292.1

[58] Field of Search ..... 144/373, 176, 144/162.1; 241/101.78, 83, 292.2, 92

[56] References Cited

U.S. PATENT DOCUMENTS

| | | | |
|---|---|---|---|
| 3,289,954 | 12/1966 | Jones | 241/298 |
| 3,452,939 | 7/1969 | Johnson | 241/255 |
| 3,759,304 | 9/1973 | Lundmark et al. | 144/180 |
| 3,856,212 | 12/1974 | Swatko | 241/56 |
| 3,976,271 | 8/1976 | Larsson et al. | 144/241 |
| 4,005,827 | 2/1977 | Frair et al. | 241/261.3 |
| 4,055,976 | 11/1977 | Kraft | 72/83 |
| 4,155,384 | 5/1979 | Svenson | 144/176 |
| 4,159,083 | 6/1979 | LaPointe | 241/68 |
| 4,161,972 | 7/1979 | Hanaya | 144/176 |
| 4,456,045 | 6/1984 | Gregoire | 144/373 |
| 4,681,270 | 7/1987 | Oberhofer | 241/298 |
| 4,887,772 | 12/1989 | Robinson et al. | 241/92 |
| 5,211,688 | 5/1993 | Rice, Sr. | 144/373 |
| 5,469,901 | 11/1995 | Leguin | 144/163 |
| 5,649,578 | 7/1997 | Leguin | 144/176 |
| 5,762,122 | 6/1998 | Rice, Sr. | 144/373 |
| 5,934,585 | 8/1999 | Chaney | 241/298 |

FOREIGN PATENT DOCUMENTS 323 872 11/1970 Sweden .

*Primary Examiner*—W. Donald Bray
*Attorney, Agent, or Firm*—Alix, Yale & Ristas, LLP

[57] ABSTRACT

A disc for a disc chipper which is adapted to rotate upon a chipper shaft is provided with a number of tools for producing chips and includes two or more sector-shaped blocks.

18 Claims, 2 Drawing Sheets

DISC FOR A DISC CHIPPER

CROSS REFERENCE TO RELATED APPLICATION

This is the U.S. national phase of International Application No. PCT/FI97/00356 filed Jun. 9, 1997.

The present invention relates to a disc for a disc chipper, said disc being adapted to rotate a disc-shipper shaft and provided with a number of knives for producing chips.

This type of chippers are used in the chipping of fibrous wood for pulping process. A typical diametric dimension for a disc in this type of a chipper is 2,5–3,8 m and the disc has a thickness of 150–250 mm. The discs are manufactured from a single quadratic piece of plate, the blank having a weight of about 10.000–30.000 kg. Manufacturers of this caliber blank plates/castings are few and far between. It is also obvious that working on the blanks requires expensive special machines.

The possible breakdown of a large-mass rapidly rotating disc during the operation of a chipper would, even in the best of circumstances, cause at least an expensive investment on spare parts, a long down-time and production halt. The disc and components associated therewith are subject to extremely strict requirements. The manufacturing costs for a qualitatively acceptable bulky blank are high and the risk of error is considerable. Therefore, it is always necessary to examine the blanks e.g. by means of ultrasonic testing for discovering possible defective points.

An object of the invention is to provide a disc for a chipper, which fulfils the high standards set for such discs, yet is superior over the prior known solutions in terms of costs.

According to the invention, this object is achieved such and a disc of the invention for a chipper is characterized in that the disc is composed of two or more sector-shaped blocks or segments.

Assembling a disc from a plurality of sector-shaped blocks offers a number of benefits: losses of raw material remain low, number of available suppliers of raw material increases, manufacturing is possible with small machine tools, the outer ring and flanges can be made from separate durable materials regardless of the material of the actual disc, the number of knives in a chipper can be altered by replacing the sector-shaped blocks (no need to replace the entire wheel), in a breakdown situation it is possible to replace only the damaged disc components, knives/knife cassettes can be provided with separate points of attachment directly in each sector-shaped block, all sector-shaped blocks can be provided with a casette/knife attachment surface beforehand at reasonable costs, the sector-shaped blocks and shaft of a disc chipper can be transported separately to an installation site, which offers benefits both in terms of transportation and assembling, a disc composed of sector-shaped blocks has a good price value because of savings in raw material, machining is more economical, a possible machining error or raw material defect is limited to the defective sector-shaped component only, the entire disc blank need not be examined separately but just the blank components, sector-shaped blocks can be castings (standard size), different parts of a disc can be made of different raw materials.

Preferred embodiments for the invention are set forth in the sub-claims.

The invention will now described in more detail by way of an example with reference made to the accompanying drawings, in which.

Figure 2:
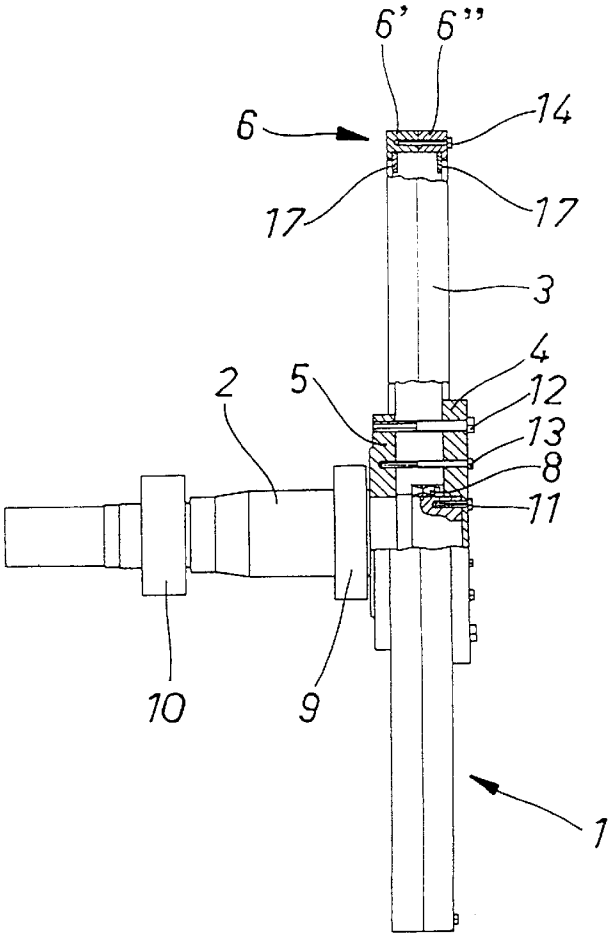
FIG. 2 shows a disc of the invention mounted on the shaft of a chipper.
Figure 1:
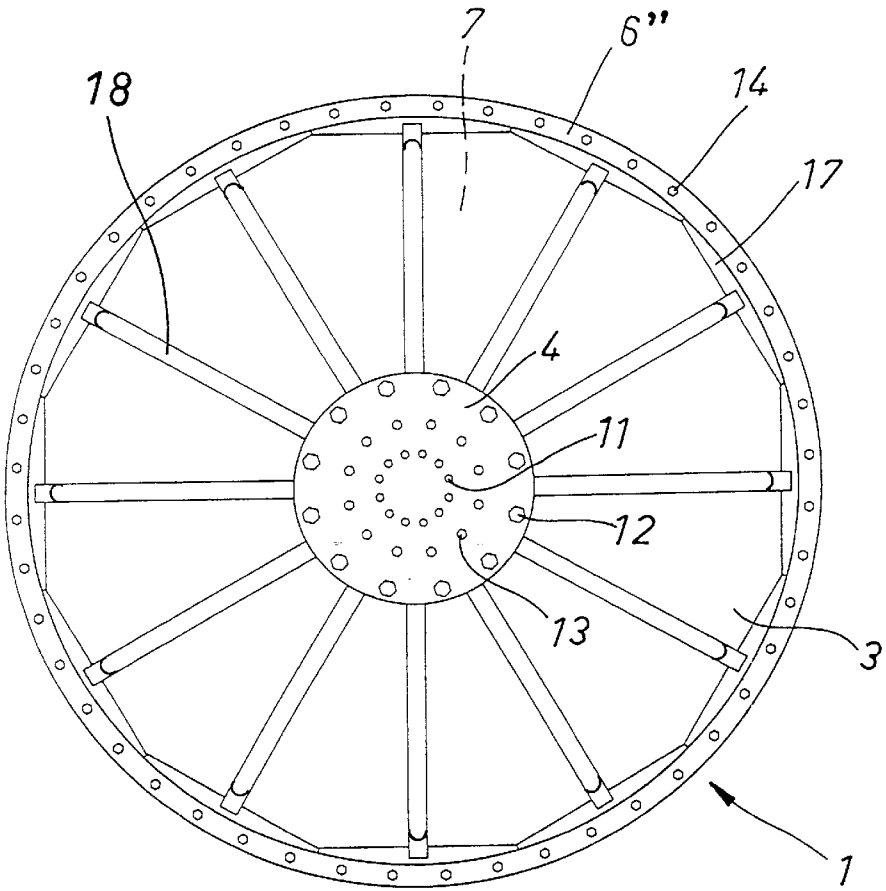
FIG. 1 shows a disc of the invention.

In FIGS. 1 and 2, a disc of the invention is generally designated by reference numeral 1. The disc 1 is adapted to rotate upon a chipper shaft 2 and provided with a number of knives (not shown in FIGS. 1 and 2) for producing chips. The shaft 2 is fixed relative to a chipper frame by means of bearings 9, 10.

In a solution of the invention, the disc 1 is composed of two or more sector-shaped blocks 3. In the example shown in FIG. 1, the disc 1 includes twelve sector-shaped blocks 3.

The sector-shaped blocks 3 can be secured to a flange which is fixed to the chipper shaft 2, in other words the flange can be made of the same material as and be integral with the shaft 2 or the flange can be a separate flange mounted on the shaft 2 in a per se known manner. In the preferred embodiment of the invention shown in FIG. 2, the sector-shaped blocks 3 are secured between a flange 5 fixed to the chipper shaft 2 and a flange 4 adapted to be movable relative to the disc-chipper shaft 2. The flange which is stationary relative to the shaft 2 comprises, in the example of FIG. 2, a flange designated by reference numeral 5, which is secured to the shaft e.g. by means of a crimp connection.

The flanges 4, 5 and the sector-shaped blocks 3 therebetween are clamped together by a number of screws 12, 13, for which the flange 4 and the sector-shaped blocks 3 are provided with through-holes and the flange 5 with threaded holes. The resulting assembly is further secured in axial direction to the end of the shaft 2 by means of screws 11 fastened through the flange 4.

In a preferred embodiment of the invention, the disc 1 includes a separate outer ring 6, providing an outer rim for the disc 1. The outer ring 6 can be composed of one or more—two, in the example of FIG. 2—continuous annular elements 6', 6". The outer ring 6 may also consist of peripherally extended elements (not shown). Instead of using the actual outer ring 6, the sector-shaped blocks 3 can be fixed to each other over the outer rim thereof by using various per se known separate fastening means.

Each sector-shaped block 3 is provided with one or more knife attachment points 7. The knife attachment point 7 is preferably machined directly on the sector-shaped block 3. A chip opening formed between two adjacent sector-shaped blocks 3 is designated with reference numeral 18.

In the preferred exemplary embodiment shown in FIG. 2, the disc 1 is provided with wedge elements 8 for tightening the sector-shaped blocks 3 between the disc-chipper shaft 2 and the outer ring 6, the latter providing the outer rim for the disc.

The sector-shaped blocks 3 can also be secured to the outer ring 6. In the example shown in FIG. 2, the sector-shaped blocks 3 are clamped by means of screws 14 into a slot or groove formed between the joined elements 6', 6" of the outer ring 6.

Figure 3:
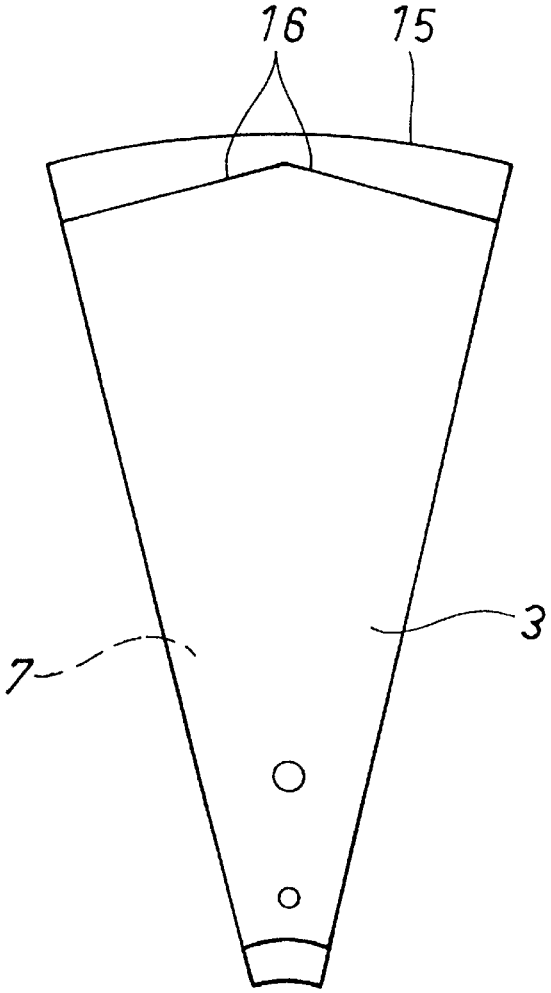
FIG. 3 shows a sector-shaped block for a disc of the invention in plan view.
Figure 4:
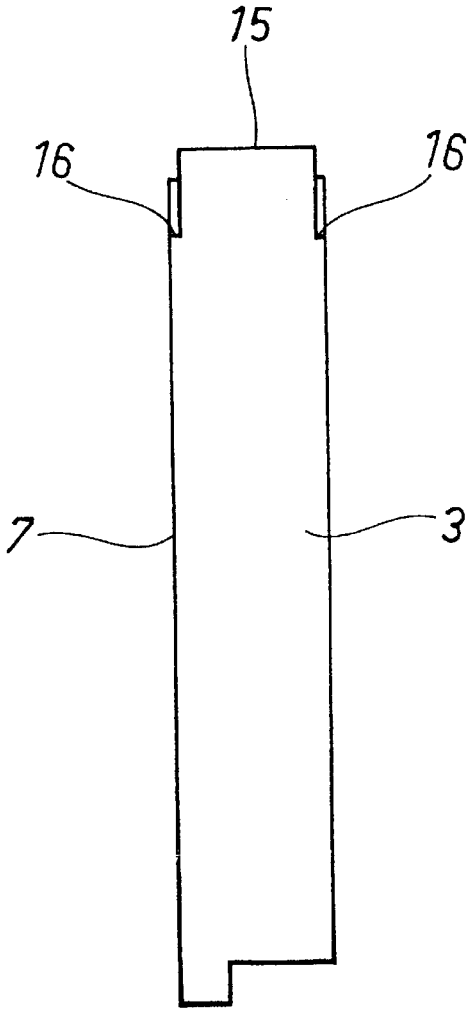
FIG. 4 shows a sector-shaped block for a disc of the invention in side view.
Figure 5:
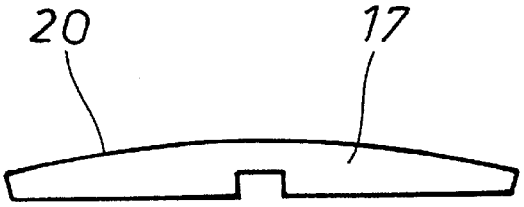
FIG. 5 shows a guide element to be fitted between the sector-shaped block of a disc of the invention and the disc.

In FIG. 3, a sector-shaped block for a disc of the invention is shown in plan view and in FIG. 4 in side view. The block 3 includes an arched side surface, which faces the outer ring 6 and is designated by reference numeral 15. However, the radial guidance of the disc 1 between the outer ring 6 and the block 3 is established in such a manner that the end of the block 3 is machined to include guide surfaces 16 for a guide element 17, best shown in FIGS. 5 and 2. The guide element 17 is provided with an arch section 20 matching the curvature of an internal groove included in the outer ring 6. Thus, as for the ends thereof facing the outer ring 6, two adjacent blocks 3 are adapted to be guided and secured to each other and to the outer ring 6 between two guide elements 27.

What is claimed is:

1. A disc for a disc-chipper, said disc being adapted to rotate upon a disc-chipper shaft, said disc having an outer circumference, an inner circumference adjacent to said disc-chipper shaft and a disc body tending therebetween, wherein said disc body consisting essentially of two or more separable sector-shaped blocks, each said block provided with a number of knives for producing chips and having a radially inner end partially defining said inner circumference, a radially outer end partially defining said outer circumference, and two angularly offset sides connecting said inner end to said outer end, said disc including a first flange which is stationary relative to the disc-chipper shaft and a second flange adapted to be axially movable relative to the disc-chipper shaft, each said block radially inner end being fixed between said first and second flanges by fasteners extending through said second flange and said block radially inner ends to engage said first flange so that each block is angularly arranged around the disc-chipper shaft in a side by side arrangement.

2. A disc as set forth in claim 1, wherein the sector shaped blocks are fixed to each other a each said outer end by means of at least one separate fastening element.

3. A disc as set forth in claim 2, wherein the fastening element comprises a separate outer ring, included in the disc and providing an outer rim for the disc.

4. A disc as set forth in claim 3, characterized in that the outer ring (6) is composed of one or more continuous annular elements (6', 6").

5. A disc as set forth in claim 3, wherein the outer ring is composed of two or more fastening elements joined together.

6. A disc as set forth in claim 1, characterized in that each sector-shaped block (3) is provided with one or more tool attachment points (7).

7. A disc as set forth in claim 6, characterized in that the tool attachment point (7) is machined directly on the sector-shaped block (3).

8. A disc as set forth in claim 3, wherein the disc is provided with at least one wedge element for displacing the sector-shaped blocks radially away from the chipper shaft and toward the outer ring, serving as the outer rim of the disc.

9. A disc as set forth in claim 2, wherein each sector-shaped block is provided with one or more tool attachment points.

10. A disc as set forth in claim 2, wherein the disc is provided with at least one wedge element for displacing the sector-shaped blocks radially away from the chipper shaft and toward the outer ring, serving as the outer rim of the disc.

11. A disc as set forth in claim 6, wherein the disc is provided with at least one wedge element for displacing the sector-shaped blocks radially away from the chipper shaft and toward the outer ring, serving as the outer rim of the disc.

12. A disc as set forth in claim 7, wherein the disc is provided with at least one wedge element for displacing the sector-shaped blocks radially away from the chipper shaft and toward the outer ring, serving as the outer rim of the disc.

13. In a disc chipper having a shaft rotatable in a direction, a modular disc consisting essentially of:

a plurality of disc sections, each section having at least one tool for producing chips, spaced inner and outer ends, and angled leading and trailing sides;

means for mounting all of said inner ends to said shaft, whereby said disc sections are fixed to said shaft for rotation therewith; and means for fastening all of said outer ends to each other, said means for fastening forming an outer rim of said disc, said outer rim fixed to said disc for rotation therewith;

wherein when said inner ends are mounted to said shaft, said disc sections are angularly arranged about said shaft in a substantially planar side by side configuration, each said inner end radially adjacent said shaft to define an inner diameter of said disc and each said outer end radially spaced from said shaft, each said leading side facing into the direction of rotation and each said trailing side facing away from the direction of rotation.

14. The disc of claim 13, wherein each disc section defines a first distance between the leading and trailing sides at the outer end and a second distance smaller than said first distance between the leading and trailing sides at the inner end.

15. The disc of claim 13 wherein said means for mounting includes a first flange which is axially stationary relative to the disc-chipper shaft and a second flange adapted to be axially movable relative to the disc-chipper shaft, said inner ends being fixed between said first and second flanges by fasteners extending through said second flange and said inner ends to engage said first flange.

16. The disc of claim 15, wherein said means for mounting includes a wedge element, said wedge element disposed between said shaft and one said disc section so that axial displacement of said wedge element radially displaces said disc section.

17. The disc of claim 13, wherein said means for fastening includes an annular channel, each said disc section outer end positionable within said channel.

18. The disc of claim 17 wherein said means for fastening includes a plurality of guide elements, said plurality of guide elements positionable within said channel and each said guide element connecting the leading side of a first said disc section with the trailing side of a second said disc section.

* * * * *